United States Patent [19]

Blauhüt

[11] Patent Number: 4,587,895

[45] Date of Patent: May 13, 1986

[54] METHOD FOR THE RADIAL COMPRESSION OF CYLINDRICAL BODIES COMPOSED OF COMPRESSIBLE MATERIAL

[75] Inventor: Wilfried T. Blauhüt, Linz, Austria

[73] Assignee: Chemie Linz Aktiengesellschaft, Linz, Austria

[21] Appl. No.: 713,741

[22] Filed: Mar. 19, 1985

[30] Foreign Application Priority Data

Apr. 19, 1984 [DE] Fed. Rep. of Germany ..... 3415036

[51] Int. Cl.[4] ..... B65B 13/20

[52] U.S. Cl. ..... 100/3; 53/439; 53/530; 100/13; 100/41; 100/158 R

[58] Field of Search ..... 53/439, 530; 100/3, 100/13, 41, 155 R, 158 R, 144, 89, 8

[56] References Cited

U.S. PATENT DOCUMENTS

| | | | |
|---|---|---|---|
| 2,974,457 | 3/1961 | Saxton | 53/530 X |
| 3,445,985 | 5/1969 | Manetta | 53/530 |
| 3,606,725 | 9/1971 | Dugan . | |

FOREIGN PATENT DOCUMENTS

| | | | |
|---|---|---|---|
| 252875 | 7/1964 | Australia | 53/530 |
| 1597272 | 7/1970 | France . | |
| 0002687 | 1/1977 | Japan | 53/530 |

*Primary Examiner*—Billy J. Wilhite

*Attorney, Agent, or Firm*—Wenderoth, Lind & Ponack

[57] ABSTRACT

Radial compression of a cylindrical body made of compressible material, is achieved by axially leading the body through a rotationally symmetrical space, which tapers in the transport direction and whose smallest diameter is smaller than that of the body to be compressed, the envelope of the rotationally symmetrical body being generated by roller shaped bodies which rotate in the same direction and cross the axis of rotation of the space at an angle of between 5° and 45° but do not intersect it. During such passage, the body performs a helical movement relative to the envelope of the rotationally symmetrical space and is compressed, the compression being made permanent by wrapping at the narrowest point of the space.

4 Claims, 5 Drawing Figures

11
12
3

III
III
II
II
12
11
3
13
5
9
2
4
3
1
6
α

METHOD FOR THE RADIAL COMPRESSION OF CYLINDRICAL BODIES COMPOSED OF COMPRESSIBLE MATERIAL

BACKGROUND OF THE INVENTION

The present invention concerns a method for the radial compression of cylindrical bodies composed of comlpressible material, in particular of rolls composed of wound flat structures, especially those which re-expand after removal of the pressure and therefore return to the original condition.

Cylindrical bodies such as are obtained by rolling strip material composed of loose, air-containing materials such as tufted textiles, fleeces, crepe, foamed material strips and the like, are voluminous and involve a large storage and transport volume, which has a substantial adverse effect on storage and transport costs.

Although it would be quite possible to compress such cylindrical bodies in the radial direction and hence economize on storage and transport volumes, no method which is usable in practice has previously been available for the solution of this problem. Winding such strips using a strong tensile stress, for example, which should lead to a reduction in volume, is not possible, either because the products lack the necessary tearing strength or else, particularly where knitted or non-woven tufted flat textile structures are concerned, they would be stretched by the tension and their structure changed.

Attempts to achieve radial compression by making the cylindrical body pass through a circular opening of smaller diameter than that of the cross-section of the cylindrical body fail because of the strong surface friction which not only demands a substantial expenditure of force but also, due to the surface friction, leads to surface damage.

SUMMARY OF THE INVENTION

In accordance with the present invention, this object is surprisingly achieved in that the cylindrical body concerned is guided in a helical relative movement through a tapering, rotationally symmetrical and approximately funnel shaped space, whose narrowest cross-section corresponds to the amount of desired radial compression of the cylindrical body and whose inner surface consists of rotating elements which make it possible to roll the body to be compressed almost without any sliding movement. By this means, the friction problems practically disappear completely and degrees of material compression of 30% by volume and more can be achieved.

The helical and almost frictionless relative movement is achieved, in accordance with the invention, in that the envelope of the tapering space providing the compression consists of several roller shaped, regularly and rotatably located bodies which are placed at such an angle relative to the longitudinal axis of the body to be compressed that they push the body to be compressed forwards with a rolling motion. By this means, the roll shaped material is compressed to an increasing extent because the cross-section of the space tapers along the longitudinal axis. When the body has reached the narrowest point in the space, the compression is made permanent by firmly wrapping with packing material.

The subject-matter of the present invention is, therefore, a method for the radial compression of cylindrical bodies composed of compressible material, in particular of rolls consisting of wound flat structures, wherein the body to be compressed is moved axially through a rotationally symmetrical space which tapers in the transport direction, whose diameter at the narrowest point is smaller than that of the body to be compressed and whose envelope is generated by several regularly distributed roller shaped bodies rotating in the same direction, which bodies cross the rotational axis of the space in its second half—seen in the transport direction—at an angle between 5 and 45° but do not intersect it, wherein the body to be compressed performs a helical movement relative to these bodies generating the envelope of the space and is compressed as a function of the ratio of its diameter to the diameter at the narrowest point, this compression being made permanent by wrapping using strip or cord material at the narrowest position of the space.

The means of producing the helical movement of the body to be compressed relative to the envelope of the tapering rotationally symmetrical space, which provides the compression and has the shape of a single-shell hyperboloid of revolution, is not important to the success of the method according to the invention. It is, for example, possible to provide the body to be compressed with a rotational movement by means of an appropriate drive and simultaneously to move it axially forwards in the direction of the narrowest point of the space, while the roller shaped bodies, which generate the envelope of the space, are rotatably supported but not driven and have an opposite rotational motion imparted to them due to the rolling movement of the body.

Preference is, however, given to the rotationally symmetrical bodies of the envelope having their own drive and being in rotation. If, in this case, the body to be compressed—which does not need to be supported but can, however, be freely supported so that it can rotate—is introduced into the rotationally symmetrical space, then, as soon as its periphery comes in contact with the rotating rollers, it will be engaged by these and have an opposing rotation imparted to it. Since the rollers are not only at an acute angle to the rotational axis of symmetry of the body but also cross it, it will be pushed forwards simultaneously and, in consequence, compressed to an increasing extent.

If, however, it is undesirable for production reasons that the body to be compressed should rotate during its compression, then it is just as easily possible, in accordance with the invention, to support this body in a fixed manner so that it cannot perform any rotational movement but only a longitudinal movement.

In this case, the rotating roller shaped bodies must have imparted to them, in addition to their own rotation, a common rotational movement—in the same direction—about the axis of rotational symmetry of the space providing the compression, which is simultaneously the longitudinal axis of the body.

Whereas the relationship between the diameter of the space providing the compression and the diameter of the cylindrical body before compression determines the amount of compression, the size of the angle between the roller shaped bodies and the longitudinal axis of the space providing the compression determines the magnitude of the pitch of the helical relative movement, so that this angle makes it possible to adapt the conditions during the compression to the nature of the body to be compressed, in particular the type and properties of its surface and the back pressure exerted by the body during compression.

An angle in the range between 10 and 35 has been found to be particularly successful.

If the material to be compressed is of a type possessing a very powerful and rapid recovery capability, it is also desirable to ensure that the spaces between the roller shaped bodies, which generate the envelope of this space, are kept as small as possible. If this is not done, there is a danger that the material to be compressed will swell out between the roller shaped bodies.

The roller shaped bodies preferably have the shape of a cylinder. If, in addition to the compression in accordance with the invention in the radial direction, a certain axial compression is also desirable, this can be achieved by giving the roller shaped bodies a tapering shape in the direction of motion, for example the shape of a single-shell hyperboloid of revolution of small curvature which, at the narrowest point, merges into a cylinder or by giving them the shape of a truncated cone.

Since unduly rapid compression is undesirable, the invention provides for the narrowest position of the space to be in the second half-seen in the transport direction—preferably, in fact, in the last third of the space. A precondition for this is that the space providing the compression should have a larger diameter at the inlet end than on the outlet end. When the diameters of the space at the inlet and outlet have been selected, the position of the narrowest point depends on the crossing angle between the longitudinal axis of the roller shaped bodies and the axis of rotational symmetry of the space. The greater this angle is, the smaller is the narrowest cross-section and the further it is displaced forwards within the second half. It is also possible to vary the degree of compression as desired by altering the angle relative to the axis of rotational symmetry of the space.

A device for carrying out the method according to the invention comprises at least five rotationally symmetrical rollers having the same diameter relative to one another and located at a crossing angle alpha of between 5° and 45° to their common axis of rotational symmetry, the generator lines of which rollers form a single-shell hyperboloid of revolution, the ends of which rollers are fastened to two annular frames (of which the frame at the outlet end has the smaller diameter) in a rotationally symmetrical arrangement, a roll for strip or packing material located outside the space enclosed by the rollers in the region of the narrowest cross-section of the space, which material is supplied via a braking device between two rolls to the cylindrical body located within the space formed by the rollers and by a removal and transport device, for the compressed body, connected to the frame situated at the outlet end.

In accordance with a preferred embodiment, the annular frames (to which the rollers are fixed and which limit the space providing the compression) are rigid, i.e. are arranged so that they cannot move, so that the rollers are fixed in position and can only perform a rotational movement about their own axes. In this case, the body to be compressed must be located so that it can freely rotate in the device so that it can perform a helical relative movement. This can occur by means of appropriate supports which permit a rotational movement. It is, however, preferred that the body to be compressed should be introduced into the space enclosed by the rollers (by means of an appropriate device, for example by a mandrel or moving roller conveyor) sufficiently far for it to be caught at its periphery by the rotating rollers and to require no special supports or retention within the device, in which it has a rotational movement imparted to it in the opposite direction to the rotational direction of the rollers and, in consequence, moves forward in a helical manner. Since the cylindrical body retains its rotational movement after leaving the device, it is necessary to ensure that any equipment accepting this body when it leaves the compression part of the device, should permit axial movement of the body and be provided with means to compensate for the rotational movement. A grooved roller block can, for example, be used for product removal purposes.

If, for any reason, the installation arrangement in which the body to be compressed is itself made to rotate proves undesirable, the device can be so embodied that in addition to the rollers limiting the space providing the compression being rotatable, the two annular frames to which the rollers are attached can also be rotated. In this case, either the rollers alone, or the annular frames (rigidly connected to one another) or both can be driven. If the frames are driven, their drive must produce a rotation in the same direction as that of the rollers. In addition, means are provided to hold the body to be compressed against any rotational movement but to permit axial movement, which can occur, for example, by means of rollers under radial pressure at inlet and outlet.

The rollers which form the rotationally symmetrical body of the device are preferably of cylindrical shape but can also have the shape of a truncated cone or of a hyperboloid of revolution. In every case, the length is a multiple of the diameter. If these rollers have the shape of a truncated cone, it is desirable that the difference between the diameter of the base and that of the top should not be too great but it is necessary to ensure in every case that the enclosed space has the tapering shape. The ratio should preferably not be greater than 2. In this case, the base is always fastened to the frame at the inlet end.

Since the desired degree of compression varies, depending on the properties of the material to be compressed and the application, it is expedient to arrange the device in such a way that the angle alpha varies and, therefore, the degree of compression can be altered or adapted. This can be very simply arranged in that one of the two annular frames is arranged so that it can be rotated to a certain extent relative to the other around the longitudinal axis of the device and that it can be fixed in the position desired for each particular case.

The supply of the packing material at the narrowest point of the device must take place via a gap between two of the rollers. In order to facilitate this, the rollers can, in accordance with one embodiment, end immediately after the narrowest point of the hyperboloid of revolution shaped space. They are then fastened to the annular frame at the outlet end by means of rods which represent an extension of the longitudinal axis of the rollers.

BRIEF DESCRIPTION OF THE DRAWINGS

Examples of possible embodiments of the invention are shown in the accompanying drawings, wherein.

DETAILED DESCRIPTION OF THE INVENTION

Figures 1, 3:
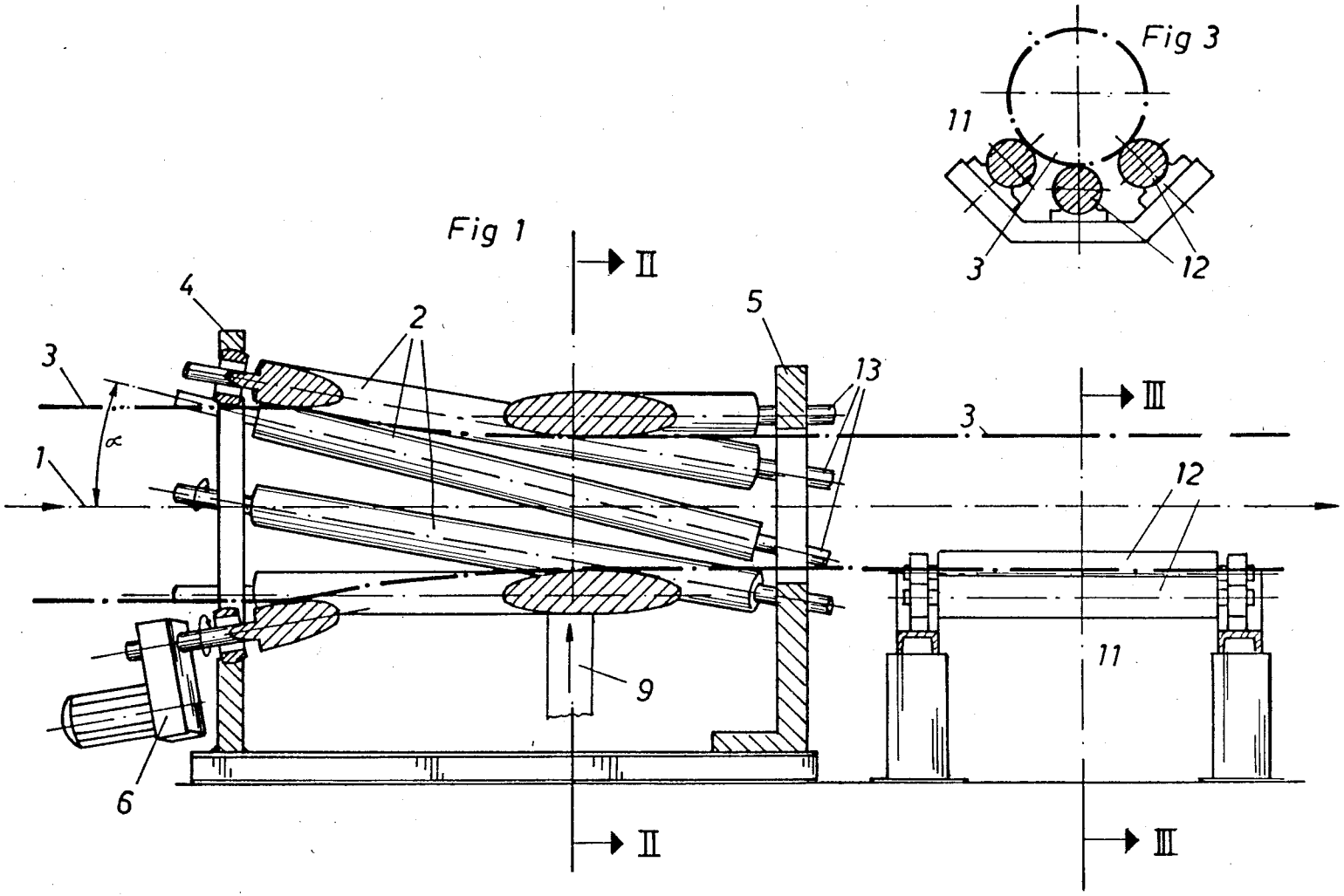
FIG. 1 is a longitudinal section through a device for carrying out the method according to the invention taken on line I—I of FIG. 2.
FIG. 3 is a section taken on line III—III of FIG. 1.

In the drawings, 1 is the axis of rotational symmetry of a space providing compression, which space is enclosed by rollers 2. 3 is a body to be compressed, 4 the annular frame at an inlet end of the device and 5 an annular frame at the outlet end. 6 represents a drive of the rollers 2. 7 is a roll of packing material 9, which is supplied to the body 3 via deflection rolls 8 and a brake device 10. 11 is a transport device for removing the body 3, which transport device is equipped with rollers 12 for accepting the rotational movement, and 13 indicates outlet end stub shafts which, in accordance with one variant of the device according to the invention, can be extended.

Figure 2:
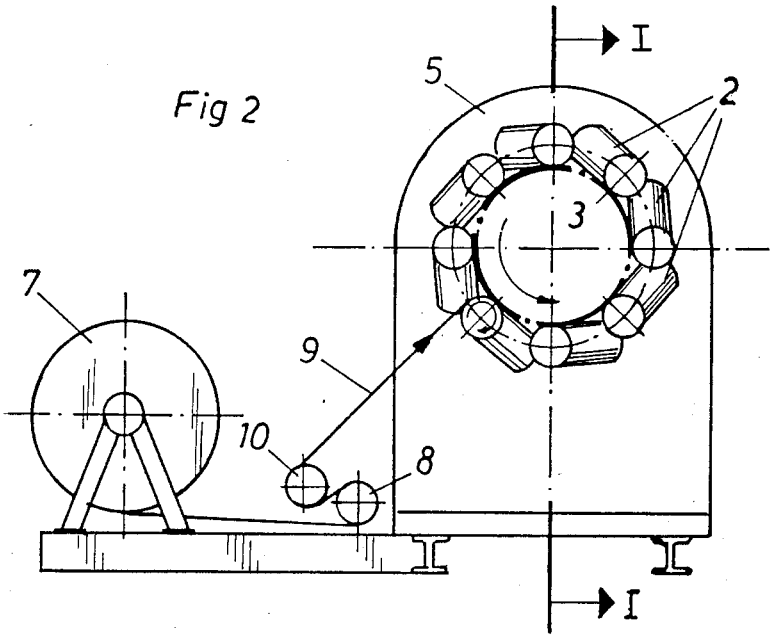
FIG. 2 is a cross section of the same device at the narrowest part of the tapering space taken on line II—II of FIG. 1.

FIG. 1 is longitudinal section through a device in accordance with the invention at the position indicated by line I—I in FIG. 2. FIG. 2 is a cross-section of the same device at the narrowest point of the tapering space. Its position is indicated by line II—II in FIG. 1. In order to make the presentation clearer, the body 3 is drawn in FIG. 1 as if it were transparent. In the embodiment of the device, in accordance with the invention, shown in this figure, the annular frames 4 and 5 are rigidly located, i.e. the body 3 must be freely rotatable. In this embodiment, it is not itself supported in bearings but is introduced (by an independent device suitable for this purpose—but not shown in FIG. 1—for example by a mandrel which is mobile, for example, mounted on a forklift truck) sufficiently far into the opening enclosed by the annular frame 4 for it to be grasped at its periphery by the rollers 2 driven by drive 6, to be set into rotation and, in consequence, to start moving forward in an axial direction and hence be compressed. FIG. 3 shows a section on the plane III—III in FIG. 1.

The annular frames 4 and 5 are not shown adjustable in FIG. 1 so that, in this embodiment, a change of an angle alpha would not be possible. This embodiment was chosen for FIG. 1 in order to make it easy to understand. The devices which are necessary in order to make one of the frames 4 or 5 sufficiently rotatable for it to provide a variation in the degree of compression by adjustment to any angle alpha within the range in accordance with the invention, are, however, known to anyone skilled in the art.

Figure 5:
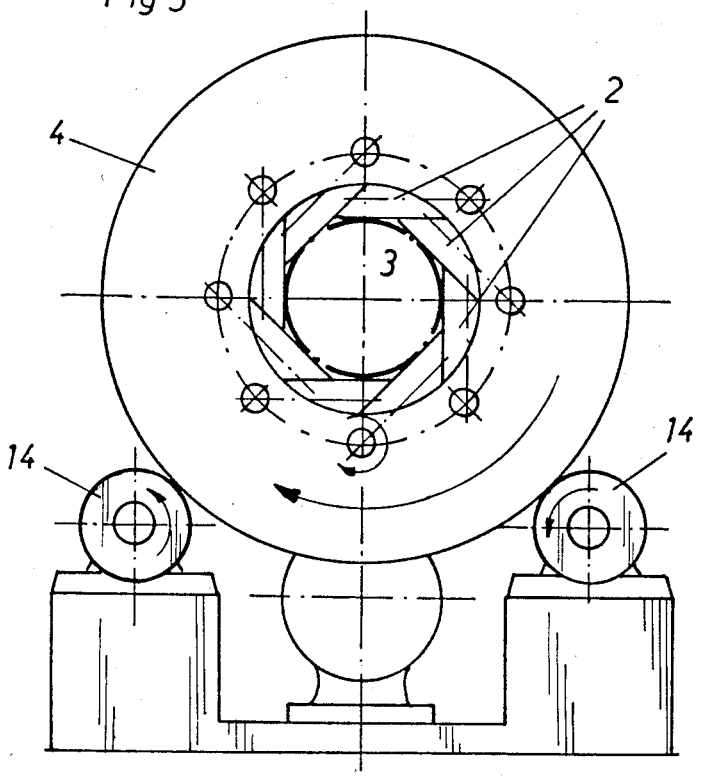
FIG. 5 is a section view taken on line V—V of FIG. 4.
Figure 4:
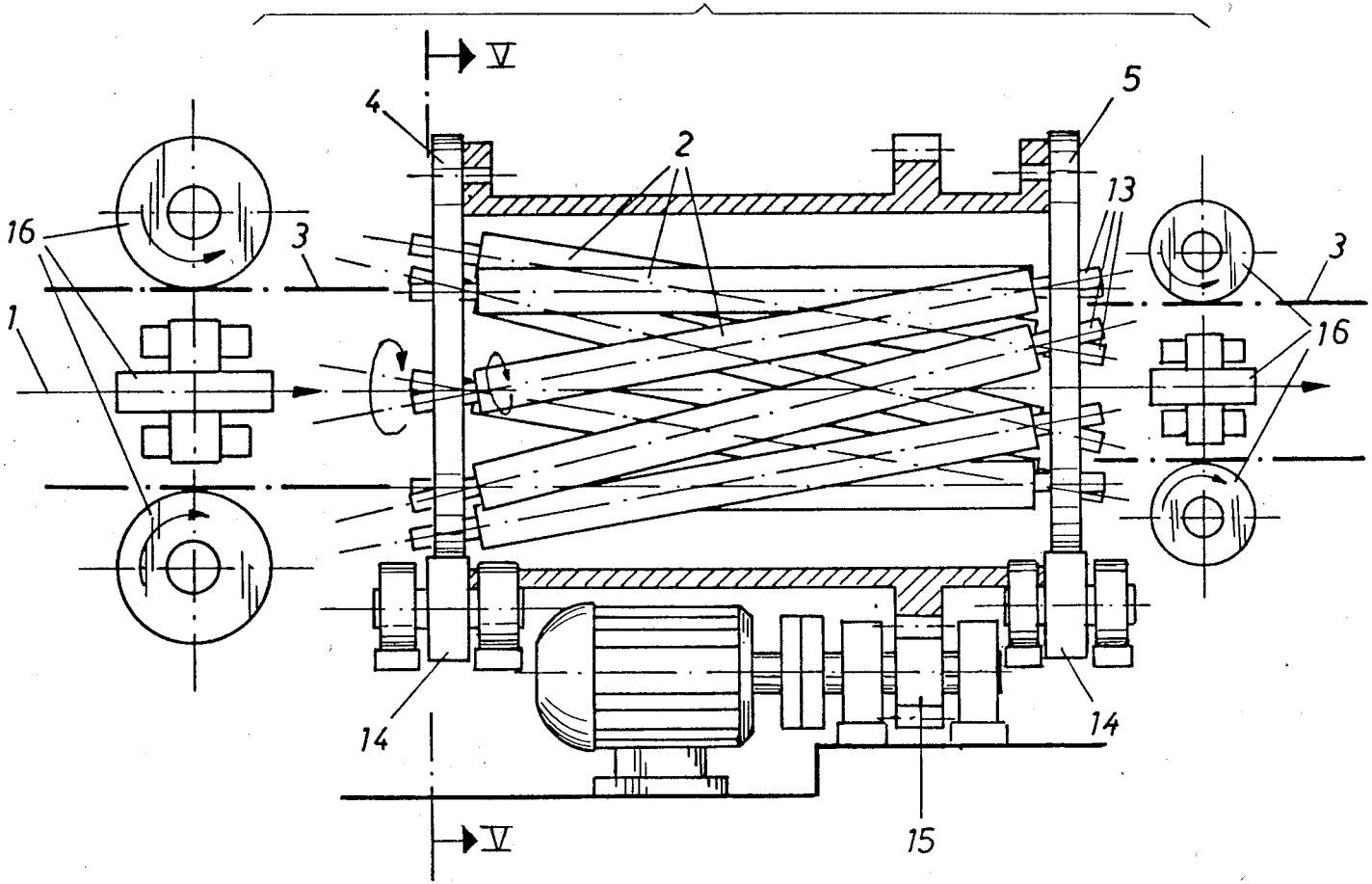
FIG. 4 is a cross section of a specific embodiment of the device in which the body to be compressed cannot perform a rotational movement.

FIGS. 4 and 5 present an embodiment in which the body 3 cannot perform any rotational movement so that, in order to achieve the effect in accordance with the invention, it is necessary for the annular frames 4 and 5 to be supported on two pairs of rollers 14. They must, in addition, be rigidly connected so that they can execute a mutually synchronous rotational movement in the same direction as the rotational movement of the individual rollers 2. 15 is a drive of the frames 4 and 5, 16 a means for preventing the rotational movement of the body 3. FIG. 5 is a section at the point indicated by line V—V in FIG. 4.

What I claim is:

1. Method for the radial compression of cylindrical bodies composed of compressible material, in particular of rolls of wound flat structures, comprising moving the body to be compressed axially through a rotationally symmetrical space, tapering in the transport direction, whose diameter at the narrowest point is smaller than that of the body to be compressed and whose envelope is generated by several regularly spaced roller shaped bodies, rotating in the same direction, which cross the axis of rotation of the space in its second half seen in the transport direction at an angle of between 5° and 45° but do not intersect it, the body to be compressed executing a helical movement relative to these bodies generating the envelope of the space, and being compressed as a function of the ratio of its diameter to the diameter of the narrowest point and making permanent this compression by wrapping with strip or cord material at the narrowest point of the space.

2. Method as claimed in claim 1, wherein the roller shaped bodies generating the envelope of the space are set into rotation and set the body to be compressed into opposite rotation during its forward movement.

3. Method as claimed in claim 1, wherein the body to be compressed only executes a simple longitudinal movement, the roller shaped bodies generating the envelope of the space are in rotation and rotate simultaneously and in common, in the sense of their own rotation, around the axis of rotation of the space, which is simultaneously the longitudinal axis of the body to be compressed.

4. Method as claimed in claim 1, wherein the angle between the axes of rotation of the roller shaped bodies generating the envelope of the space and the rotational axis of the body to be compressed is between 10° and 35°.

* * * * *